United States Patent [19]

Paddock et al.

[11] 3,950,943

[45] Apr. 20, 1976

[54] AIR DIVERTER VALVE

[75] Inventors: Gordon R. Paddock, Rochester, N.Y.; Ernst L. Ranft, Sudbury, Mass.

[73] Assignee: General Motors Corporation, Detroit, Mich.

[22] Filed: May 20, 1974

[21] Appl. No.: 471,360

[52] U.S. Cl. ..... 60/290; 137/115; 137/118

[51] Int. Cl.[2] ..... F02B 75/10; H01M 6/00

[58] Field of Search ..... 60/289, 290; 137/118, 137/115

[56] References Cited

UNITED STATES PATENTS 3,748,855 7/1973 Day ..... 60/290

3,805,522 4/1974 Sheppard ..... 60/290

*Primary Examiner*—Douglas Hart

*Attorney, Agent, or Firm*—C. K. Veenstra

[57] ABSTRACT

In a system for delivering air from an air pump to the exhaust system of an internal combustion engine, an air diverter valve assembly has a regulating control responsive to air pump discharge pressure which positions the diverter valve member to divert excess air flow away from the exhaust system when the pressure exceeds a selected value. The assembly also has a timed anti-backfire provision effective to override the regulating control and divert all air flow to the atmosphere upon a sudden decrease in induction manifold pressure.

1 Claim, 3 Drawing Figures

AIR DIVERTER VALVE

This invention relates to an air diverter valve assembly for use in a system which delivers air from an air pump to the exhaust system of an internal combustion engine and, more particularly, to an air diverter valve assembly which has a pressure responsive servomotor for diverting excess air flow to the atmosphere when the air pressure exceeds a selected value.

Air diverter valve units such as the one set forth in copending application U.S. Ser. No. 301,619 filed Oct. 27, 1972, now U.S. Pat. No. 3,835,646,; include pressure relief and anti-backfire provisions. In those units, the anti-backfire provision comprises an actuating diaphragm energized by a sudden decrease in manifold pressure to lift a diverter valve member, preventing air flow to the exhaust system and diverting it to the atmosphere; for a selected period of time during closed throttle deceleration. During that period, a bleed opening through the diaphragm gradually; equilibrates pressures acting on opposite sides of the diaphragm to allow a spring to lower the valve member at the end of the period, thus reestablishing air flow to the exhaust system. If manifold pressure increases, during that period, a check valve opens to permit flow through the actuating diaphragm. This also equilibrates the pressures thereacross and allows the spring to lower the diverter valve member, thus reestablishing air flow to the exhaust system.

In a positive-displacement, engine-driven air pump, the air flow is proportional to engine speed and the air pump discharge pressure increases as engine speed increases. However, in some applications as the speed increases it may be desirable to direct excess air flow when the pressure exceeds some empirically selected value. If excess air flow is not as diverted, the exhaust gas may be leaned to a point which would inhibit oxidation reactions in the exhaust system.

The pressure relief provision of the prior art units generally comprises a preloaded pop-off valve which vents a portion of the air flow to the atmosphere when a predetermined air pump discharge pressure is exceeded. The pressure relief provision thus reduces the pressure and diverts excess air flow away from the exhaust system. However, such pop-off valves tend to cycle between fully open and fully closed positions rather than continuously diverting excess air. Moreover, cycling of such valves during high speed operation limits the relief capacity and thus they cannot divert the quantity of air which may be desired.

In the present invention, a diverter valve member is positioned in response to air pressure so that the diverter valve member diverts excess air flow from the exhaust system when the pressure exceeds a selected value. A pressure responsive regulating diaphragm positions the diverter valve member to divert excess air in a manner which avoids the hunting or cycling experienced with prior art pop-off valves. In addition, the diverter valve member may directly restrict air flow to the exhaust system, rather than merely opening a second air flow path as in the prior art.

This diverter valve assembly also may have a conventional actuating diaphragm for anti-backfire control. In such an embodiment, a servomotor housing and associated cover member, which form atmospheric and pressure chambers partitioned by the regulating diaphragm is secured to the lower housing of the conventional anti-backfire control diverter value unit. The regulating diaphragm is responsive to the superatmospheric air pressure to control the diverter valve member, bu the actuating diaphragm overrides the regulating diaphragm and lifts the diverter valve member to the full divert upon a sudden decrease in induction manifold pressure.

The details as well as other objects and advantages of this invention are set forth in the remainder of the specification and are shown in the drawing in which.

Figure 1:
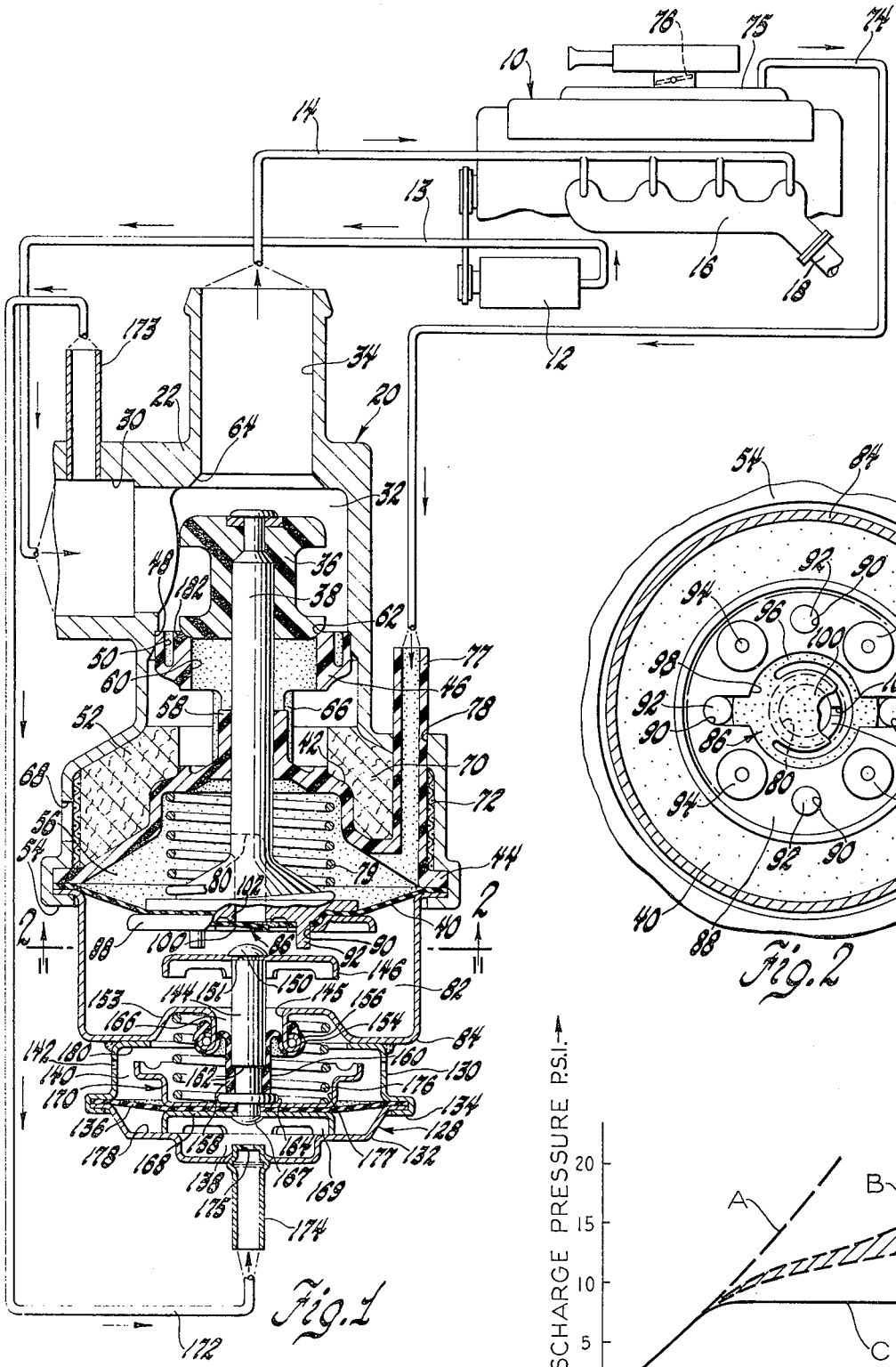
FIG. 1 is a schematic view of an internal combustion engine having an air pump for delivering air to the exhaust system and showing the air diverter valve assembly -- in an enlarged sectional elevational view -- disposed between the pump and the exhaust system.

Referring first to FIG. 1, an internal combustion engine 10 has an air pump 12 which supplies air through an air flow line 13 and a conduit 14 to the exhaust manifold 16 or to another portion of the exhaust system 18. The air supports combustion of exhaust gas hydrocarbons and carbon monoxide.

An air diverter valve assembly 20 is mounted between line 13 and conduit 14. The upper housing 22 of assembly 20 has passage extending from a lateral inlet 30 through a valve chamber 32 to a main outlet 34. Air is received from air pump 12 through inlet 30 and is discharged through main outlet 34 to conduit 14.

A valve menber 36 is disposed in valve chamber 32 and is secured to the upper end of a valve stem 38. The lower end of valve stem 38 is secured to an actuating diaphragm 40 which closes the lower end of housing 22.

A fiberglass-reinforced nylon insert member 42 is secured about its lower rim 44 between diaphragm 40 and housing 22. The upper rim 46 of insert 42 is pressed into a bore 48 of housing 22 -- a deep groove 50 in rim 46 facilitating the press fit.

The press fit of rim 46 in bore 48 prevents direct leakage of air from valve chamber 32 to the annular chamber 52 defined between insert 42 and housing 22. The lower rim 54 of housing 22 is spun over rim 44 of insert 42 and the peripheral edge of diaphragm 40 to seal a vacuum chamber 56, defined between diaphragm 40 and insert 42, from annular chamber 52. A guide portion 58 of insert 42 fits closely about stem 38 both to support and guide stem 38 and to prevent leakage of air from chambers 32 and 52 into chamber 56.

Insert 42 has a cylindrical recess or diversion outlet 60 surrounding guide portion 58. The upper periphery of recess 60 defines a lower valve seat 62 which is engaged by the lower portion of valve member 36. When valve stem 38 is displaced upwardly, valve member 36 will be moved away from valve seat 62 and toward an upper valve seat 64 surrounding main outlet 34. This will reduce air flow through main outlet 34 and will divert the excess air flow into recess 60 from which it passes into annular chamber 52 through a pair of diametrically opposed apertures 66. The air then flows from chamber 52 through a plurality of apertures 68 to the atmosphere.

An annular pad of silencing material 70 may be optionally disposed in chamber 52 and may be surrounded by a ring of screening material 72 to prevent the silencing material 70 from puffing outwardly into apertures 68.

A conduit 74 extends from the induction system intake manifold 75 downstream of throttle 76 to a fitting 77 formed as a portion of insert member 42 and extending through an opening 78 in housing 22. During engine deceleration, manifold pressure decreases abruptly, and the pressure in chamber 56 decreases correspondingly to raise diaphragm 40 and valve stem 38 against the bias of a spring 79. This lifts valve member 36 from a full flow position against seat 62 to a full divert position against seat 64, thereby interrupting air flow from pump 12 to exhaust manifold 16 and diverting the air flow to the atmosphere to thus prevent backfiring in the exhaust system.

As shown in FIG. 1, a passage 80 extends through the lower portion of valve stem 38. This passage connects chamber 56 with a control chamber 82 defined between diaphragm 40 and a lower cup-shaped housing 84, secured to housing 22 by rim 54 to upper seal chamber 82 from the atmosphere. A check valve 86 is disposed across the bottom of passage 80 to regulate flow between chamber 82 and chamber 56.

Figure 2:
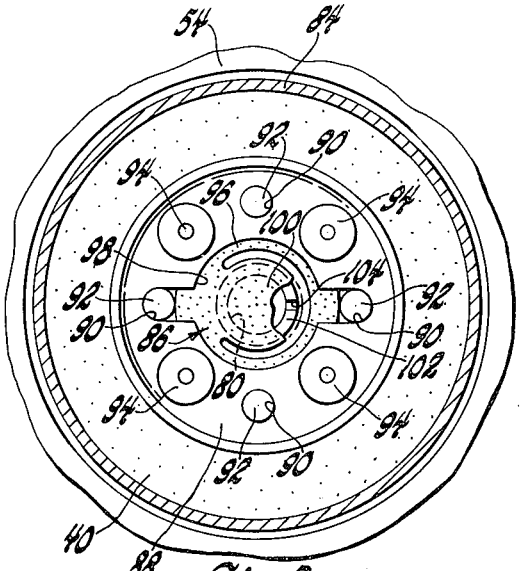
FIG. 2 is a view indicated by the line 2-2 in FIG. 1 further enlarged to show the check valve included in the actuating diaphragm assembly.

The details of check valve 86 are best shown in FIG. 2. A washer member 88 is disposed under diaphragm 40 and has a plurality of apertures 90 which receive downwardly extending legs 92 formed on the lower portion of valve stem 38. Four of these legs are riveted, as at 94, to retain washer 88 against valve stem 38.

The outer rim 96 of check valve 86 is supported by the inner rim 98 of washer 88. A central flap 100 of check valve 86 overlies an annular valve seat 102 formed at the base of stem member 38. A notch 104 is coined in seat 102.

During the period when the manifold pressure is decreasing, flow from control chamber 82 through passage 80 to vacuum chamber 56 is restricted in passing through notch 104. Thus, the volume of chamber 82 and the size of notch 104 determine the time required for the pressure in chamber 82 to be reduced to the point where spring 79 will lower diaphragm 40, stem member 38 and valve member 36 to the position shown. During a period of increasing manifold pressure central flap 100 will be pushed downwardly to allow unrestricted flow from chamber 56 through passage 80 to chamber 82 and thus permit immediate return of diaphragm 40, stem member 38 and valve member 36 of the position shown.

In accordance with the present invention, a regulating control 128 is provided to position valve member 36 in response to the superatmospheric air pressure in order to divert excess air when the pressure exceeds a selected value.

As shown in FIG. 1, regulating control 128 comprises a servomotor housing 130 which is welded to the lower housing 84. A lower cover member 132 is secured to the bottom of housing 130 by means of a spun over rim 134. A circular flexible regulating diaphragm 136 is secured between cover member 132 and housing 130 and partitions the interior of regulating control 128 into a pressure chamber 138 between cover member 132 and regulating diaphragm 136 and an atmospheric chamber 140 between diaphragm 136 and housing 130. Atmospheric pressure is admitted to chamber 140 through a plurality of openings 142 formed in housing 130.

An upwardly extending rod 144 is centrally secured to diaphragm 136 and is axially disposed in a sleeve 145 formed in lower housing 84. An upper platen 146 is attached to the uppermost end 150 of rod 144 by upsetting end 150 to force platen 146 against a shoulder 151. It should be noted that platen 146 extends radially to underlie the downwardly extending legs 92 of valve stem 38. Accordingly, platen 146 may engage legs 92 of valve stem 38 when the platen is raised a selected height by diaphragm 136.

Sleeve 145 is terminated by an outwardly rolled lip 154 which is adapted to secure the conforming lip 156 of a rolling flexible hermetic seal 158. The other end 160 of rolling seal 158 conforms with and resides between a shoulder 162 of rod 144 and a flange 164 integral with rod 144. The space 166 between rod 144 and sleeve 145 is sufficient to accommodate a double thickness of rolling seal 158 so that as rod 144 reciprocates therein rolling seal 158 may invert itself within space 166 aas shown in FIG. 1. Thus, seal 158 prevents fluid communication between control chamber 82 and atmospheric chamber 140 while allowing rod 144 to reciprocate.

Regulating diaphragm 136 is secured to rod 144 by upsetting a head 167 to force a lower platen 168, having ears 169, an upwardly extending annular stop 170, and diaphragm 136 into interengagement. Ears 169 are provided to allow fluid flow around lower platen 168.

Air at pump discharge pressure is admitted to pressure chamber 138 through a conduit 172 connecting a fitting 173 opening from inlet 30 with a fitting 174 extending downwardly from cover member 132. An orifice 175 in fitting 174 controls the rate of fluid flow to chamber 138 to reduce pressure pulsations in chamber 138.

A regulating spring 176 is disposed about rod 144 between a spring retainer well 153 formed in lower housing 84 and a retainer well 177 formed as part of stop member 170. Spring 176 biases diaphragm 136, rod 144, platens 146 and 168, and stop 170 downwardly and urges platen 168 against a land 178 of cover member 132.

When the air pressure exceeds a selected valve lift-off value, regulating diaphragm 136 acts through rod 144, platen 146, legs 92 and stem 38 and overcomes springs 176 and 79 to lift valve member 36 away from its full flow position against seat 62 to a partial divert position. In a partial divert position, valve member 36 directs a portion of the air through main outlet 34 to the exhaust system and diverts the excess air through recess 60, annular chamber 52 and apertures 68. Regulating diaphragm 136 then controls valve member 36 to maintain a constant pressure -- raising valve member 36 to divert a greater portion of the air flow as the pressure tends to increase and lowering valve member 36 to reduce the portion of air flow diverted as the pressure tends to decrease.

It will be appreciated that as valve member 36 initially moves away from seat 62, the downward force due to pressure on the top of valve member 36 is balanced out by exposure of the bottom of valve member 36 to the same pressure. Thus valve member 36 will not be returned to seat 62 until the pressure drops to a valve seating pressure somewhat lower than the valve lift-off pressure, and hunting of valve member 36 with accompanying chatter against seat 62 is avoided.

A metering angle 182 may be formed as part of the lower portion of valve member 36 to assist in metering the air flow diverted to the atmosphere as valve member 36 is lifted off seat 62. This metering angle can be proportioned so that the pressure does not substantially decrease below the initial liftoff pressure.

The resistance or backpressure met by air flowing through silencing material 70 is less than the backpressure met by air flowing through outlet 34 to the exhaust system. Thus if regulating diaphragm 136 were to lift valve member 36 to the full divert position against seat 64 at high pressures, the pressure would be relieved to such an extent that springs 79 and 176 would quickly lower valve member 36. Of course, once valve member 36 moves away from seat 64 and the high pressure is restored, regulating diaphragm 136 would again lift valve member 36 to the full divert position. To preclude such hunting of valve member 36 with accompanying chatter against seat 64, stop 170 engages the top 180 of servomotor housing 130 and prevents regulating diaphragm 136 from lifting valve member 36 to the full divert position against seat 64. Therefore as the pump approaches its peak discharge pressure at the upper end of its speed range, a fixed proportion of the air flow will be delivered to the exhaust system and excess air will be diverted through recess 60, annular chamber 52 and apertures 68 to the atmosphere.

It will be appreciated that the pressure range or difference between the seating pressure and the pressure required to engage stop 170 against top 180 can be made as small as practicable.

It should also be noted that during steady state operation no pressure differential will occur across actuating diaphragm 40 when manifold vacuum increases abruptly during deceleration, actuating diaphragm 40 overrides the regulating function provided by regulating control 128 and moves upwardly away from platen 146; to move valve member 36 to the full divert position against seat 64. This curtails air flow to prevent backfiring in the exhaust system.

Figure 3:
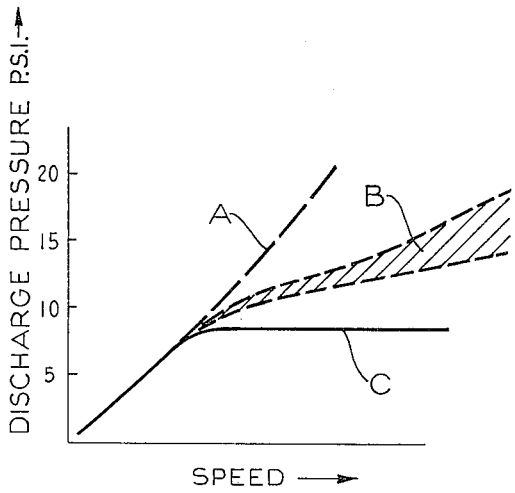
FIG. 3 is a graph of the speed versus pressure characteristics for several systems and shows the improved manner of control achieved by this invention.

FIG. 3 shows the speed versus discharge pressure characteristics of an air pump without any pressure relief provision (curve A), an air pump having a pop-off pressure relief valve (curve B), and an air pump controlled by the present invention (curve C). In curve A, the discharge pressure increases linearly with speed, which is undesirable for emission control since the volume of air delivered at high speeds will inhibit oxidation of carbon monoxide and hydrocarbons. Curve B shows that the prior art pop-off valves reduce but do not maintain a constant pressure at high speeds. Finally, curve C shows that, with the present invention, pressure is limited to a selected level for optimum oxidation of the undesirable combustible exhaust constituents.

We claim:

1. An air diverter valve assembly for use on an internal combustion engine having an induction system for air flow to the engine, a throttle in said induction system for controlling air flow therethrough, an exhaust system for exhaust gas flow from the engine, and a pump for delivering air to the exhaust system, said air diverter valve assembly comprising an upper housing defining a passage having an inlet for receiving air from said pump, a main outlet for discharging air to said exhaust system, and a diversion outlet aligned with said main outlet for diverting air away from said exhaust system, a diverter valve member reciprocable between a full flow position obstructing air flow through said diversion outlet and directing the entire air flow through said main outlet and a full divert position obstructing air flow through said main outlet and diverting the entire air flow through said diversion outlet, a spring biasing said valve member to said full flow position, a lower housing secured to said upper housing, an actuating diaphragm connected to said valve member and secured between said housings to define a vacuum chamber between said diaphragm and said upper housing and a control chamber between said diaphragm and said lower housing, said vacuum chamber having means adapted to sense the vacuum in said induction passage downstream of said throttle, said diaphragm having a bleed permitting restricted flow from said control chamber to said vacuum chamber, a servomotor housing secured to said lower housing, a cover secured to said servomotor housing, a regulating diaphragm secured between said servomotor housing and said cover to define an atmospheric chamber between said diaphragm and said servomotor housing and a pressure chamber between said diaphragm and said cover, said pressure chamber having a conduit sensing the pressure in said passage, means secured to said regulating diaphragm and effective when the pressure in said passage exceeds a selected value to engage said actuating diaphragm and move said valve member to a partial divert position between said full flow position and said full divert position for dividing the air flow between said outlets to divert excess air through said diversion outlet and maintain said pressure at a substantially constant value, and stop means preventing said regulating diaphragm from moving said valve member to said full divert position, and wherein said actuating diaphragm moves said valve member to said full divert position upon a sudden increase in said vacuum irrespective of the pressure in said passage.

* * * * *